US011193262B2

(12) United States Patent
Gilde et al.

(10) Patent No.: US 11,193,262 B2
(45) Date of Patent: Dec. 7, 2021

(54) COMBINED FLUSHING AND FILLING UNIT AND METHOD FOR THE OPERATION THEREOF

(71) Applicant: LIXIL INTERNATIONAL Pte. Ltd., Singapore (SG)

(72) Inventors: Christian Gilde, Karlsruhe (DE); Achim Heinzle, Ras al Khaimah (AE); Oliver Seidel, Karlsruhe (DE)

(73) Assignee: AS America, Inc., Piscataway, NJ (US)

( * ) Notice: Subject to any disclaimer, the term of this patent is extended or adjusted under 35 U.S.C. 154(b) by 0 days.

(21) Appl. No.: 16/958,675

(22) PCT Filed: Dec. 28, 2018

(86) PCT No.: PCT/IB2018/060687
§ 371 (c)(1),
(2) Date: Jun. 26, 2020

(87) PCT Pub. No.: WO2019/130259
PCT Pub. Date: Jul. 4, 2019

(65) Prior Publication Data

US 2021/0062488 A1 Mar. 4, 2021

(30) Foreign Application Priority Data

Dec. 28, 2017 (DE) ..... 10 2017 131 399.0

(51) Int. Cl.
*E03D 1/36* (2006.01)
*E03D 5/02* (2006.01)
*E03D 5/10* (2006.01)

(52) U.S. Cl.
CPC ..... *E03D 1/36* (2013.01); *E03D 5/024* (2013.01); *E03D 5/10* (2013.01)

(58) Field of Classification Search
CPC ..... E03D 1/36; E03D 5/024; E03D 5/10
USPC ..... 4/313, 366, 367
See application file for complete search history.

(56) References Cited

U.S. PATENT DOCUMENTS 4,989,277 A * 2/1991 Tsutsui ..... E03D 5/10 4/367
2019/0039877 A1* 2/2019 Le ..... E03D 1/36

FOREIGN PATENT DOCUMENTS

| | | |
|---|---|---|
| CN | 202577518 U | 12/2012 |
| CN | 203334387 U | 12/2013 |
| CN | 108222132 A | 6/2018 |
| DE | 227644 | 12/1908 |

(Continued)

*Primary Examiner* — Tuan N Nguyen
(74) *Attorney, Agent, or Firm* — Tyler A. Stevenson; Anna-Lisa L. Gallo

(57) ABSTRACT

A combined flushing and filling unit comprising a flush valve and a filling valve, which are situated in an inlet chamber to which line pressure is to be applied, and, between the inlet chamber and a particular outlet line, form a compensation chamber, each of which is closed with the aid of a servo-diaphragm, wherein the inlet chamber communicates with the compensation chambers via a connection opening, in each case, in the servo-diaphragm, and the compensation chambers each have a control opening for generating a pressure decrease, which releases the particular outlet line, in the relevant compensation chamber. Furthermore, a method for the operation of a combined flushing and filling unit comprising a flush valve for triggering an emptying process of a cistern is disclosed.

20 Claims, 9 Drawing Sheets

(56) References Cited

FOREIGN PATENT DOCUMENTS

| | | | |
|---|---|---|---|
| DE | 69717222 | T2 | 4/2003 |
| DE | 102014019290 | A1 | 3/2016 |
| EP | 0369404 | A1 | 5/1990 |
| EP | 2123832 | A1 | 11/2009 |
| EP | 3048207 | A1 | 7/2016 |
| GB | 2317191 | A | 3/1998 |
| WO | 95/04196 | A1 | 2/1995 |

* cited by examiner

COMBINED FLUSHING AND FILLING UNIT AND METHOD FOR THE OPERATION THEREOF

CROSS-REFERENCE TO RELATED APPLICATIONS

This application is a national stage application under 35 USC 371 of International Application No. PCT/IB2018/060687, filed Dec. 28, 2018, which claims the priority of German Application No. 10 2017 131 399.0, filed Dec. 28, 2017, the entire contents of each of which are incorporated herein by reference.

FIELD OF THE DISCLOSURE

The present disclosure relates to a combined flushing and filling unit and to a method for the operation thereof.

BACKGROUND OF THE DISCLOSURE

A combined flushing and filling valve is already known from DE 227 644 A. Described therein is an electrically actuated flushing device which initially opens a flush valve via a lever mechanism and, as a result of changing weight ratios and as a result of pressure differences within a counter pressure chamber, after emptying is practically complete, the flushing device then actuates a filling valve in order to refill the cistern.

Although this solution combines the filling valve and the flush valve into one extended component, it also has numerous disadvantages. For example, a triggering must take place, for example, via an electromagnet which sets a solid lever into motion, and therefore a considerable amount of force renders a permanent electrical installation necessary. Due to the early filing date, a battery solution was not yet provided in that case.

DE 10 2014 019290 A1 also describes such a combined flush and filling valve, wherein, in a valve assembly, the flush valve supplies a cylinder-piston unit with water, which results in a piston being lifted and, consequently, the water stored in the cistern flowing out. A filling valve is likewise actuated and refills the cistern until a float in the region of the filling valve indicates that the cistern has been sufficiently filled again.

In addition, numerous solutions are known from the prior art, which utilize separate filling and flush valves which become operational due to different boundary conditions in each case. In one relatively simple solution, a flush valve is triggered by the user and remains open for as long as it is pressed and held. When the actuation is released, the flush valve is then likewise closed. In this case, the filling valve becomes operational as soon as the water level drops below a fill position defined by a float and closes when the fill position is reached.

These known solutions are problematic, however, in that the various flushing mechanisms are only partly adaptable to different cisterns. Due to changing customary practices or due to structural requirements, the shape and volume of cisterns can differ, and therefore known flushing devices are adaptable in terms of the size thereof. In this case, it should always be ensured that, during installation of a flushing device, the plumber initially manually adjusts the flushing device to the correct dimensions before he/she then arranges the two parts of the filling valve and of the flush valve with respect to each other and ensures that the two elements cooperate correctly. Finally, it must be ensured by way of suitable settings that the flushing quantity is also correctly metered, provided such a distinction is carried out both in the case of a small flushing volume and in the case of a large flushing volume.

Electrically actuated solutions generally dispense with a hard-wired electrical installation for safety reasons. The utilized battery-operated valves require a large amount of energy, however, in order to close the valves counter to the force of the supply pressure prevailing in the lines and to overcome the water column present in the cistern during opening. As a result, batteries utilized in this area become fully discharged very rapidly and must be frequently replaced.

SUMMARY OF THE DISCLOSURE

Against this background, the problem addressed by the present disclosure is that of providing a combined flushing and filling unit which both permits a precise metering of the flushing water and an energy-saving blocking of the supply pressure, and can be compactly manufactured and requires only a very small amount of energy for controlling the system.

This problem is solved by a combined flushing and filling unit according to the features disclosed and/or claimed herein. This problem is further solved by a method for operating such a combined flushing and filling unit according to the features disclosed and/or claimed herein. Meaningful embodiments both of the device and of the method are found in the disclosure.

According to the disclosure, it is provided to connect a single inlet tube and to secure the unit in the cistern, in one shared, compact design. Both the flush valve and the filling valve abut a shared inlet chamber which is ultimately supplied by way of the inlet tube. The pressure of the supply line, which is utilized in the present case for actuating the two valves, is therefore present in the inlet chamber. With the aid of a pilot valve, both the filling valve and the flush valve block an outlet line which leads into a filling line in the case of the filling valve and, in the case of the flush valve, into a cylinder-piston unit which triggers the flushing process. Located behind the servo-diaphragm in each case is a compensation chamber which communicates with the inlet chamber via a connection opening. Likewise, each of the compensation chambers has a control opening, through the opening of which a pressure decrease in the relevant compensation chamber can be effectuated. The line pressure in the inlet chamber then presses the servo-diaphragm aside and releases the particular outlet line.

Therefore, the combined flushing and filling unit comprises a flush valve and a filling valve, which are situated in an inlet chamber to which line pressure is to be applied. The line pressure may represent the pressure of the (public) water supply or the water supply network. Between the inlet chamber and a particular first outlet line and second outlet line, a first compensation chamber and a second compensation-chamber is formed, each of which is closed with the aid of a respective first servo-diaphragm and second servo-diaphragm. The inlet chamber communicates with the first compensation chamber via a first connection opening in the first servo-diaphragm and with the second compensation chamber via a second connection opening in the second servo-diaphragm. The first compensation chamber has a first control opening for generating a pressure decrease, which releases the first outlet line in the first compensation chamber. The second compensation chamber has a second control opening for generating a pressure decrease, which releases the second outlet line in the second compensation chamber.

The (at least one) connection opening may be provided in form of a (permanently open) hole in the servo-diaphragm, as well known by the skilled person. Usually, in some embodiments, the connection opening ensures that the compensation chamber is always filled with water and that the same pressure applies in the inlet chamber and in the compensation chamber as long as the control opening is not used to lower the pressure in the compensation chamber. Because the surface of the servo-diaphragm which is exposed to the compensation chamber is greater than the surface of the opposite side of the servo-diaphragm which is exposed to the inlet chamber, the force which applies from the compensation chamber side onto the servo-diaphragm is greater than the force which applies from the inlet chamber side onto the servo-diaphragm. Accordingly, the servo-diaphragm is pressed against the outlet and the valve is closed.

If the control opening is used to lower the pressure in the compensation chamber, the force which applies from the compensation chamber side onto the servo-diaphragm is lowered to a value being below the force which applies from the inlet chamber side onto the servo-diaphragm. Accordingly, the servo-diaphragm moves towards the compensation chamber and lifts of the valve seat/outlet. As a result, the outlet is opened.

The number and/or the cross section of the control openings and the connection openings are adapted to ensure the described functionality. Such an adaptation can easily be achieved by a person skilled in the art.

If the control opening is then closed again, water flows through the connection opening communicating with the inlet chamber and back into the compensation chamber until the same pressure prevails therein as in the inlet chamber. The diaphragm covers both the inlet chamber and the outlet line on the outside, however, as viewed from the compensation chamber; on the inner side, however, the pressure of the compensation chamber prevails everywhere, and therefore the diaphragm will close the outlet line again due to the larger surface area on the inner side, to which pressure is applied. Due to the surface area being larger on the inside than on the outside, the identical pressure as in the inlet chamber suffices for sealing the inlet chamber and the outlet line again.

Due to this arrangement of the combined flush and filling valve, the two valves can switch the full line pressure, in each case by way of a simple opening and closing of the control opening, for the purpose of which only a very small amount of force is required. The service life of a battery utilized for this purpose is much greater than the service life of a battery for an actuator directly actuating the valve. In addition, the shared mounting of the valves allows for a highly compact design.

As described above, the outlet line of the filling valve is followed by a filling line which fills the cistern again after a flushing process. The outlet line of the filling valve opens into a filling line of the cistern and the outlet line of the flush valve leads into an inlet line (of a cylinder of a cylinder-piston unit) for triggering the flushing process. The filling line may be a vertical downpipe which comprises an air tube, which is open at one end, above an opening into the filling line.

In order to prevent greywater from being suctioned back into the supply line, the filling line is vertically arranged and meets the horizontally installed outlet line. While the water flowing in via the filling valve drops downward due to the gravity in the filling line, the filling line is extended upward, beyond the inflow of the outlet line, and is open at the end, and therefore, in the case of a negative pressure occurring in the supply line, this negative pressure cannot be maintained in the structure and no greywater can flow out of the cistern back into the supply line.

The filling line may comprise a baffle plate in the transition to the outlet line of the filling valve. The baffle plate can be assigned to the outflow of the outlet line into the filling line, by means of which the inflowing water is braked and diverted and the noise which develops during flowing into the cistern is reduced. It is likewise prevented, as a result, that splash water forms.

The actuation of the flush valve and of the filling valve takes place, as described above, by way of the closing and opening of the control openings. This can take place with the aid of plungers which can be actuated via a rotatably mounted camshaft and/or can be pressed onto the particular control openings independently of each other, with the aid of actuators, in some embodiments electric motors. To some advantage, the plungers, as well as the valves themselves, can be situated directly next to each other, and therefore the plungers can be operated with the aid of a camshaft. The camshaft rotates, in this case, at the end face of the two plungers mounted in parallel to each other and pushes them, via the control cam thereof, out of a closed neutral position into an open position. In addition, in some embodiments, the plungers can be resiliently mounted, in order to always reliably return to the neutral position from the closed position, in case of doubt.

In order to be able to precisely detect the particular rotational position of the camshaft, the camshaft can comprise a light wheel consisting of a wheel which is connected to the camshaft and includes inscribed recesses or passages. By means of a lamp and a photoreceptor oriented toward the lamp, including a light wheel situated therebetween, the present rotational position of the light wheel can be deduced on the basis of gap widths and resultant light intensities. In order to allow for a more precise detection of the position, the light wheel may have different gap sizes for a start position, adjustment positions, and other intermediate positions.

In order to enable the camshaft to rotate, the camshaft can be driven by an arbitrary actuator, in some embodiments an electric motor. The electric motor is controlled by a control unit which receives input signals from various signal transmitters and sensors, evaluates the input signals, and then outputs adjustment signals to the electric motor, in order to move the electric motor and, therewith, the camshaft. Inter alfa, the control unit receives sensor signals from the aforementioned photoceptor regarding the position of the camshaft.

In addition, there are also a few further data sources for the control unit, however, on the basis of which the control unit implements the control of the flush valve and of the filling valve. The control unit further comprises a microprocessor which includes a timer. The timer measures the time, during which an adjustment position is held, or specifies a time, during which the flush valve is held open. The flushing time can be, in some embodiments, preset or influenced by means of one or multiple potentiometers.

Likewise, the control unit can be connected in a data-sharing manner to a fill-level detection device. As soon as a predefined fill level has been reached, an actuating signal is output, and therefore the filling valve is closed in this case. This can be implemented, for example, with the aid of a conventional float which, once the highest level has been reached, actuates a switch as soon as the float is floating on the surface of the water. For this purpose, some embodiments provide, however, that a pair of electrodes is installed or situated, in some embodiments, in the region of a maximum fill level in the cistern or at the highest water level. If the water rises to the level of the electrodes, the resistance changes and, in turn, a fill-level signal is generated and transmitted to the control unit. This likewise functions with the aid of a capacitance measurement between the two electrodes.

In one specific embodiment, the electrodes can furthermore be conductively doped silicone threads or made of conductively doped silicone threads. Due to the metal doping thereof, the silicone threads are conductive, on the one hand and, on the other hand, they contribute the positive properties of silicone, in particular the water resistance thereof, and therefore silicone threads are particularly suitable for use in the cistern. At the same time, these silicone threads, when suitably placed in the cistern, can also function as a sealing, in some embodiments for sealing the service unit, and for compensating for tolerances.

Yet another sensor system to be connected to the control unit relates to a volumetric flow rate detection device. The flowing water can be best detected upon entering the cistern; this is very difficult upon exiting the cistern, and, in the worst case, interferes with the flushing performance. Specifically, volumetric flow rate detection can therefore take place with the aid of a flowmeter which is situated in the inlet line. Such a flowmeter can be implemented, for example, in the form of an impeller which is situated in the inlet line and comprises a permanent magnet. If a reed contact is situated in the engagement region of this permanent magnet, it can be established, during a suitable control measurement and even during the production process, which volume corresponds to which rotational speed. By way of the use of such a flowmeter, the control unit can take into account which quantities of water flow into the cistern in which amount of time. Since the water which has flowed out must, in some embodiments, also flow back in, and since the amount of water still flowing in during a filling process can be detected via the fill-level measurement, it can also be ascertained how much water runs out at which flushing duration. In this way, a precisely set flushing quantity which is to be utilized per flushing process can be established for the flushing duration.

Yet another aspect of the disclosure consists of avoiding damage to the diaphragms and the mechanisms. Pollution loads from the pipeline network are therefore to be avoided. For this purpose, it is common to provide a filter insert in the supply line, which holds back these pollution loads. A filter insert may be assigned to the supply line which is situated in a coupling between an inlet tube connected to the supply network and an inlet line upstream from the volumetric flow detection device. The inlet tube may be connected to the inlet line via a clamp connection, wherein the clamp connection is in some embodiments released with the aid of a yoke by sliding.

In order to also mount this filter insert in an accessible and service-friendly manner in such a way that it can be easily removed and replaced, cleaned, and maintained, a coupling is situated between a supply line and the means for volumetric flow rate detection and is connected on one side to the tube connected to the supply line and, on the other side, to an inlet line upstream from the means for volumetric flow rate detection. By way of this position, it is possible to disconnect the tube line from the inlet line at the coupling and remove the filter insert from the coupling, in order to clean or replace the filter insert. A removal of the entire structure, as is the case, in part, in the prior art, can be avoided as a result.

To some advantage, the inlet tube and the coupling can be connected to the inlet line by means of a clamp connection. Such a clamp connection cannot be released when line pressure is applied. Such a clamp connection can be released once the water has been shut off and the pressure has decreased.

In one specific embodiment, such a clamp connection can be implemented via a yoke which is mounted over a terminal peripheral collar on the tube end. If the yoke extends in a slide in this case, the tube end cannot be pulled out of the yoke and the clamping is closed. Once the pressure has been reduced and the yoke has been pushed to the side, the tube end can be removed and the filter insert can be replaced.

According to another aspect of the disclosure, a method for the operation of a combined flushing and filling unit comprising a flush valve for triggering an emptying process of a cistern, and a filling valve for triggering a filling process is disclosed. The flush valve and the filling valve are situated adjacent to each other and the actuation of which takes place via a control unit by way of an electric motor-controlled camshaft. The method may comprise at least the following steps:

a. rotating the camshaft out of a start position into a first adjustment position, in which only the flush valve is actuated,
b. after a flushing time specified by a microprocessor, which is in some embodiments calculated from a volume of a flowmeter and a set flushing quantity, rotating the camshaft further into a second adjustment position, in which only the filling valve is actuated,
c. holding the camshaft in position until the fill-level detection device signals a complete filling of the cistern back to the control unit,
d. rotating the camshaft back into the start position.

One complete process consists of a flushing process and a filling process.

If the flushing process is started, for example via an electrical triggering mechanism, the control unit initially receives the message that the triggering mechanism has been actuated. Thereupon, the control unit, with the aid of the electric motor, will rotate the camshaft out of a start position into a first adjustment position and, therefore, remove the plunger from the control opening of the flush valve by means of the corresponding control cam. The water present in the inlet chamber will now run into the cylinder and start the flushing process. The water now exits the cistern.

After a predefined flushing time which is specified to the control unit by a microprocessor, the control unit, in turn, with the aid of the electric motor, rotates the camshaft further into a second adjustment position, in which the flush valve is closed again and the filling valve is opened therefor. The camshaft therefore remains in place in this case as well, until the control unit receives a response from the means for fill-level detection indicating that the cistern is sufficiently filled again. Subsequent thereto, the camshaft is rotated back into the start position at the end of the process.

In some embodiments, in order to ensure that the flush valve is always closed when the fill valve opens, the camshaft can be moved into an intermediate position which is between the first adjustment position and the second adjustment position. The camshaft remains in the intermediate position for a closing duration which can be, for example, approximately one second, until it is possible to advance to the second position.

As part of an optional upstream teach-in process, the cistern is initially filled until the fill-level detection device signals a complete filling of the cistern back to the control unit), wherein, with the aid of a volumetric flow rate detection device provided in the inlet line, the water volume which has flowed in is determined and is signaled back to the control unit, wherein, when a first flushing then occurs, an initial value of the flushing time is specified and this process is repeated for as long as it takes and the flushing time is adjusted each time until a specified flushing quantity of water is discharged during each flushing.

One essential piece of information in the system is the correct flushing time, i.e., the amount of time which the flush valve is to remain open, in order to allow the correct quantity of water to run out. Since the water quantity cannot be determined while the water is running out, the measurement is carried out during inflow. As part of an upstream teach-in process, the cistern is therefore initially completely filled until the means for fill-level detection signal back to the control unit that the cistern has been completely filled. In a first flushing process, a first flushing time is then specified, for example 600 ms [milliseconds], and then the amount of water that flows in is measured. The value is updated for as long as it takes for a specified flushing quantity per flush to be discharged.

The above described method can be carried out with the combined flushing and filling unit described herewith.

Furthermore, a combined flushing and filling unit having a control unit which opens and closes the filling valve and the flushing valve by way of an electric motor-controlled camshaft and being adapted to execute the steps of the independent method is disclosed.

The impeller of the flowmeter located in the water supply line is equipped with a coated permanent magnet, which triggers a reed contact mounted below the water supply line with each turn. Based on the water volume determined per turn of the impellor, i.e. with each signal which the reed contact transmits to the microprocessor (e.g. via the cable connection), the microprocessor calculates the volume of the water flowed through.

The fill-level detection device (comprising e.g. electrically conductive silicone strings) gives a signal to the microprocessor when the maximum water level defined according to the standard is reached (e.g. by means of an electric "short circuit" caused by the water). This signal stops the filling of the cistern and thus also the water inflow and the rotation of the impeller.

The control by the microprocessor is stored in the program in such a way that the flushing duration is time-controlled. As an example: a 6 liter flush is stored with an output value of 0.5 seconds. After the first flushing with an opening time of the flushing valve of 0.5 seconds, the volume of the refilling of the water tank up to the maximum water level by the impeller of the volumetric flowmeter is measured with the aid of the reed contact. The number of turns of the impeller gives the actual value of the refilled volume (actual quantity) of water. This value is compared with the target quantity stored in the program (6 liters in the example).

If the actual quantity deviates from the nominal quantity, the program adjusts the opening time of the flushing valve accordingly and the initial value of 0.5 seconds is extended or shortened accordingly (extended if the quantity falls below the nominal value or shortened if the quantity exceeds the nominal quantity).

The adjustment of the opening time may take place with each flushing until a minimum deviation, which is defined in a further tolerance band, is reached for this individual installation situation with the corresponding line pressure. If the supply line pressure changes or if the desired flushing volume is changed accordingly, the system automatically readjusts itself to the new requirements within 2-3 flushing releases. Thus, a constant flushing accuracy of +–0.15 liters per flush can be achieved.

Another aspect of the disclosure relates to a computer program product comprising instructions to cause the combined flushing and filling unit as disclosed and/or claimed herein to execute the steps of the a method as disclosed and/or claimed herein. Yet another aspect of the invention is a computer-readable medium having stored thereon that computer program product.

BRIEF DESCRIPTION OF THE FIGURES

The above-described disclosure is described in greater detail in the following with reference to some embodiments.

DETAILED DESCRIPTION OF THE DISCLOSURE

Figure 1:
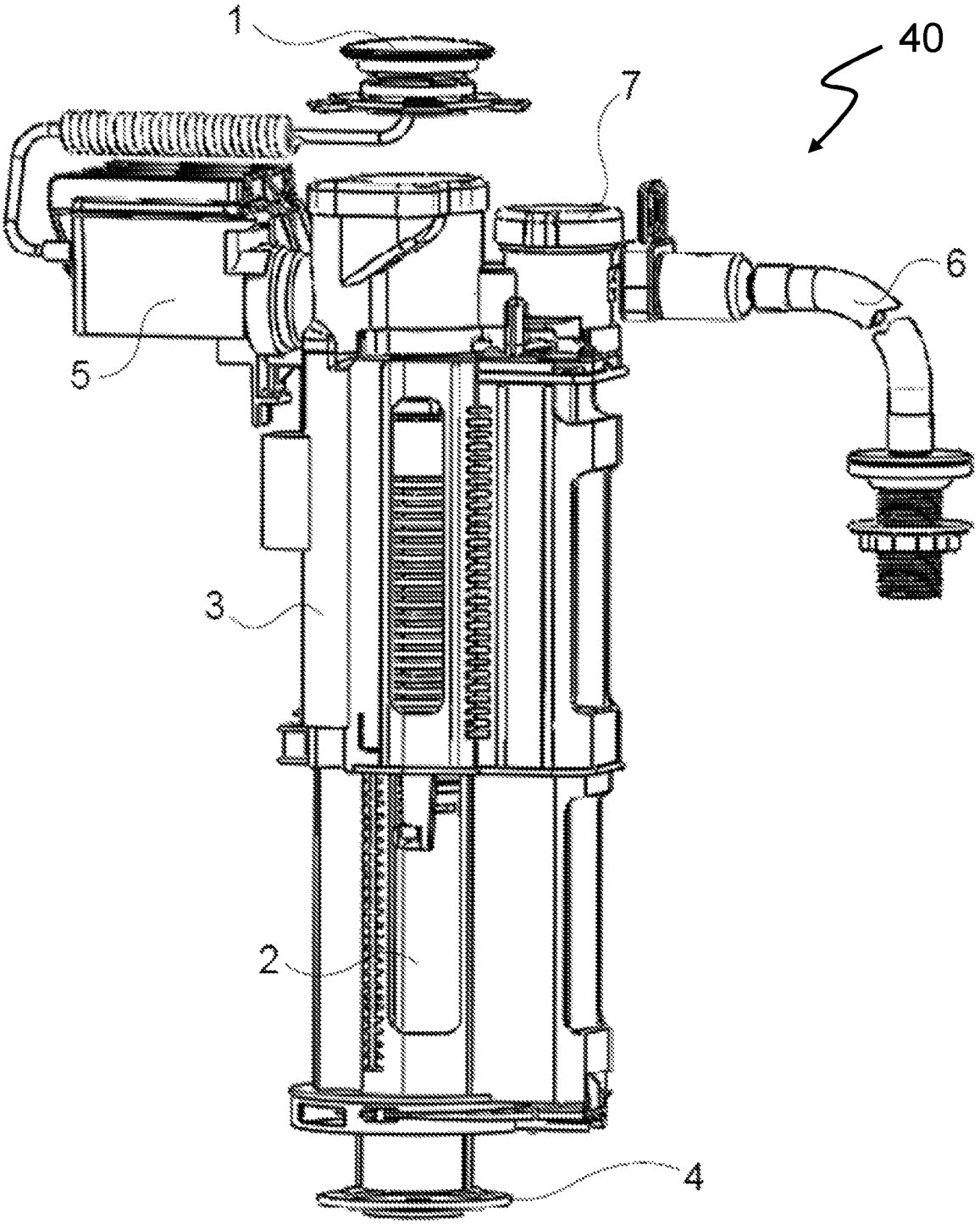
FIG. 1 shows a perspective representation, obliquely from the front, of a combined flushing and filling unit as a total system, according to some embodiments.

FIG. 1 shows a compact combined flushing and filling unit 40 which can be installed, in entirety, in a cistern of a toilet. In this case, the unit is completely adaptable to the size of the cistern and can be adjusted to the desired quantity of flushing water using only a few manipulations. With the aid of an electrical triggering mechanism 1, a flushing process is started, in which an upright tube 2 is lifted, thereby opening up space for the outflow of the water contained in the cistern, via a basin connector 4. The upright tube is guided in a cage 3 which is height-adjustable and, therefore, adaptable to the height of the cistern. In the subsequent flushing process, water is conveyed out of the supply line, via an inlet tube 6, into the cistern, the introduced volume is detected with the aid of a flowmeter 7 and, once the desired fill level has been reached, the further inflow is shut off. This is controlled in a service unit 5, in which the control applications run. A substantial portion of these control applications of the service unit 5 are represented in the following, in FIGS. 2 to 5.

Figure 2:
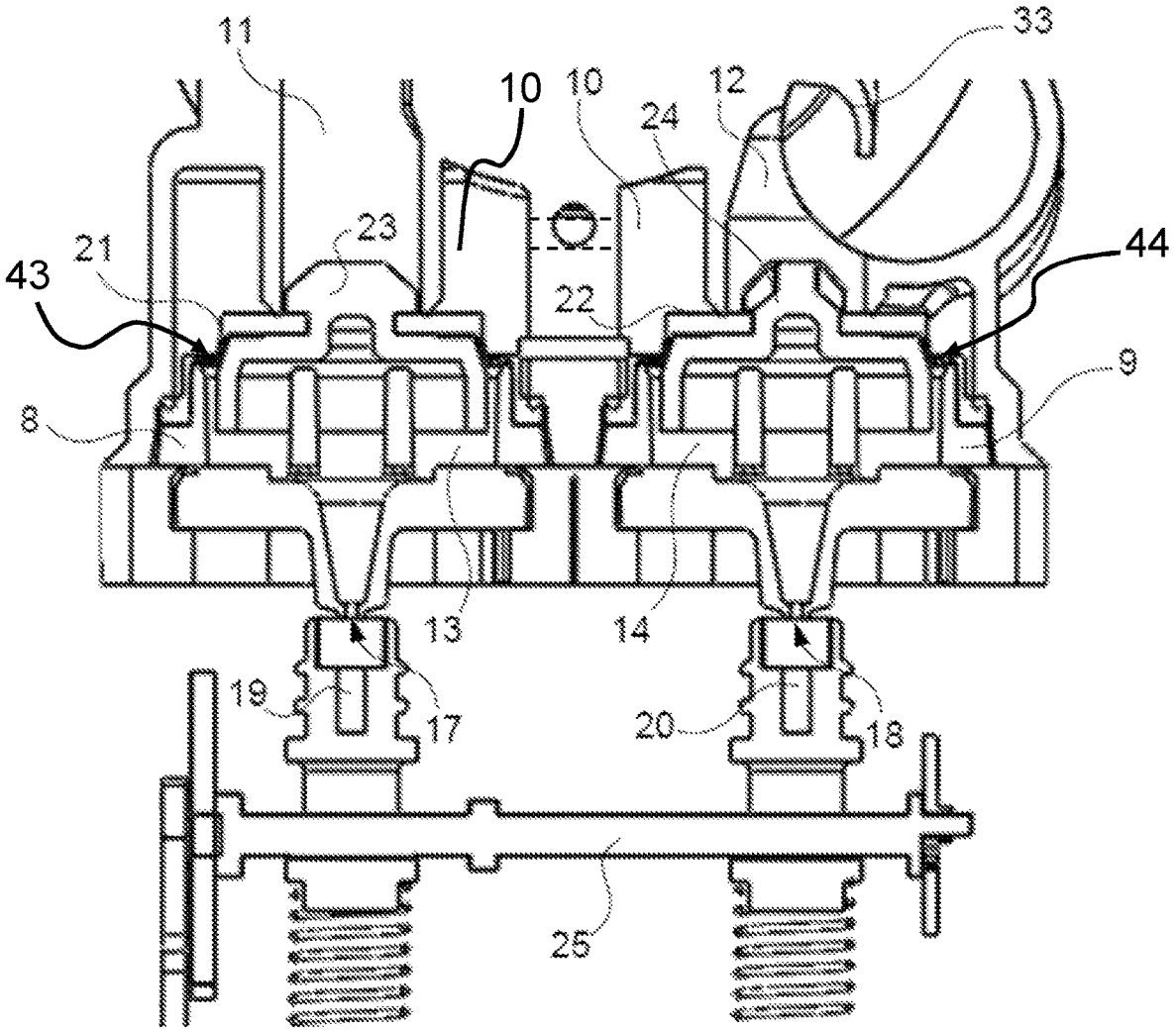
FIG. 2 shows a top view from above of a schematic representation of the flush and filling valves in a start position, according to some embodiments.

FIG. 2 shows the flush valve 8 and the adjacent filling valve 9, which are actuated by way of the service unit 5 with the aid of a camshaft 25. The flush valve 8 and the filling valve 9 have substantially the same design; they merely bring about different effects. The flush valve 8 separates an inlet chamber 10 from a first outlet line 11 which opens into a cylinder which is flooded with water in order to trigger the flushing process. The filling valve 9, however, separates the same inlet chamber 10 from a second outlet line 12 which opens into a filling line which empties into the cistern.

FIG. 2 shows the start position, in which the flush valve 8 and the filling valve 9 are closed. This is ensured by means of two plungers (first plunger 19 and second plunger 20) and the rubber seals situated on the ends thereof, which close the control openings (first control opening 17 and second control opening 18). The control openings 17 and 18 belong to the compensation chambers (first compensation chamber 13 and second compensation chamber 14) which are each assigned to one of the valves.

Figure 3:
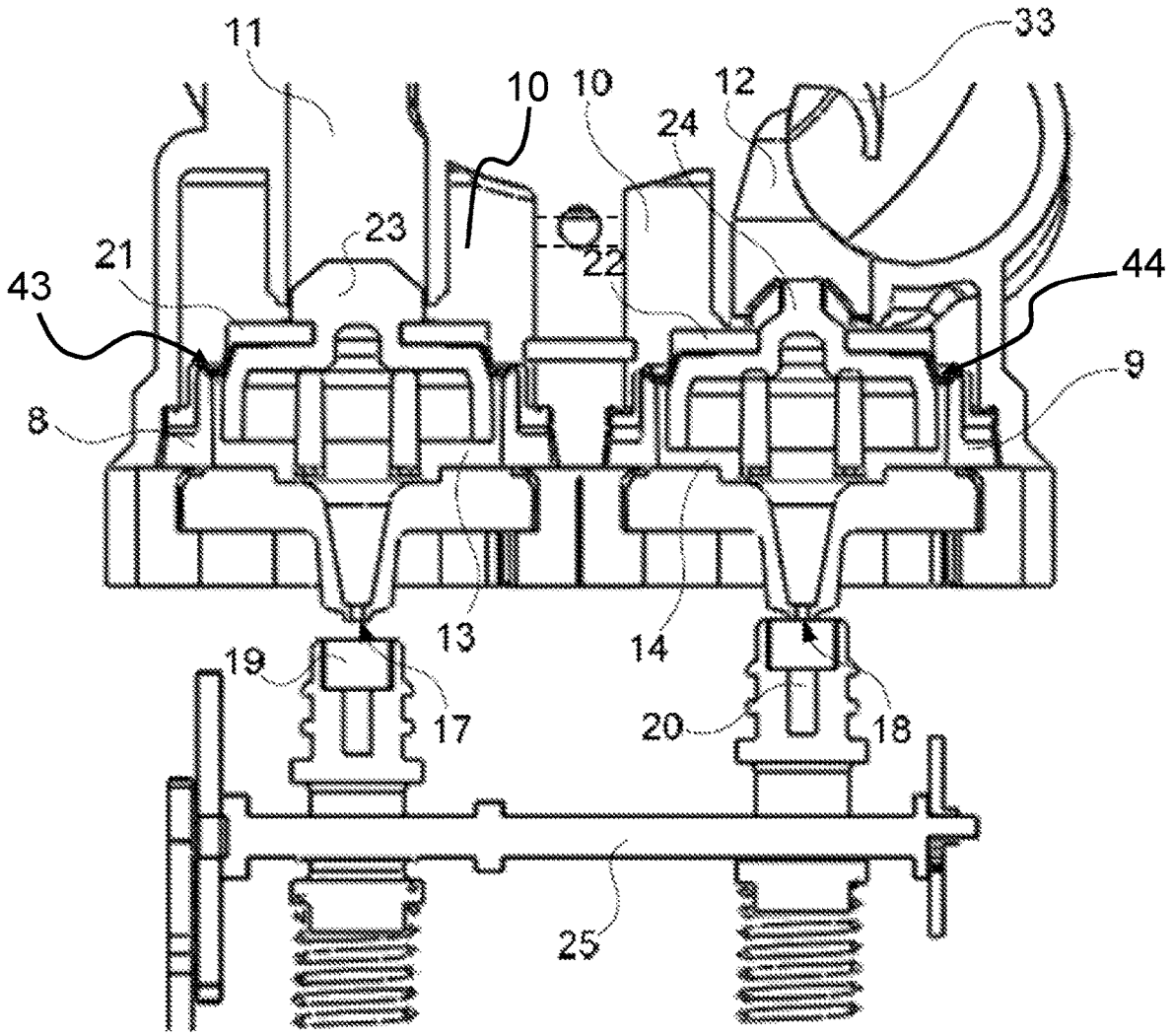
FIG. 3 shows a top view from above of the flush and filling valves according to FIG. 2 in a first adjustment position, according to some embodiments.
Figure 4:
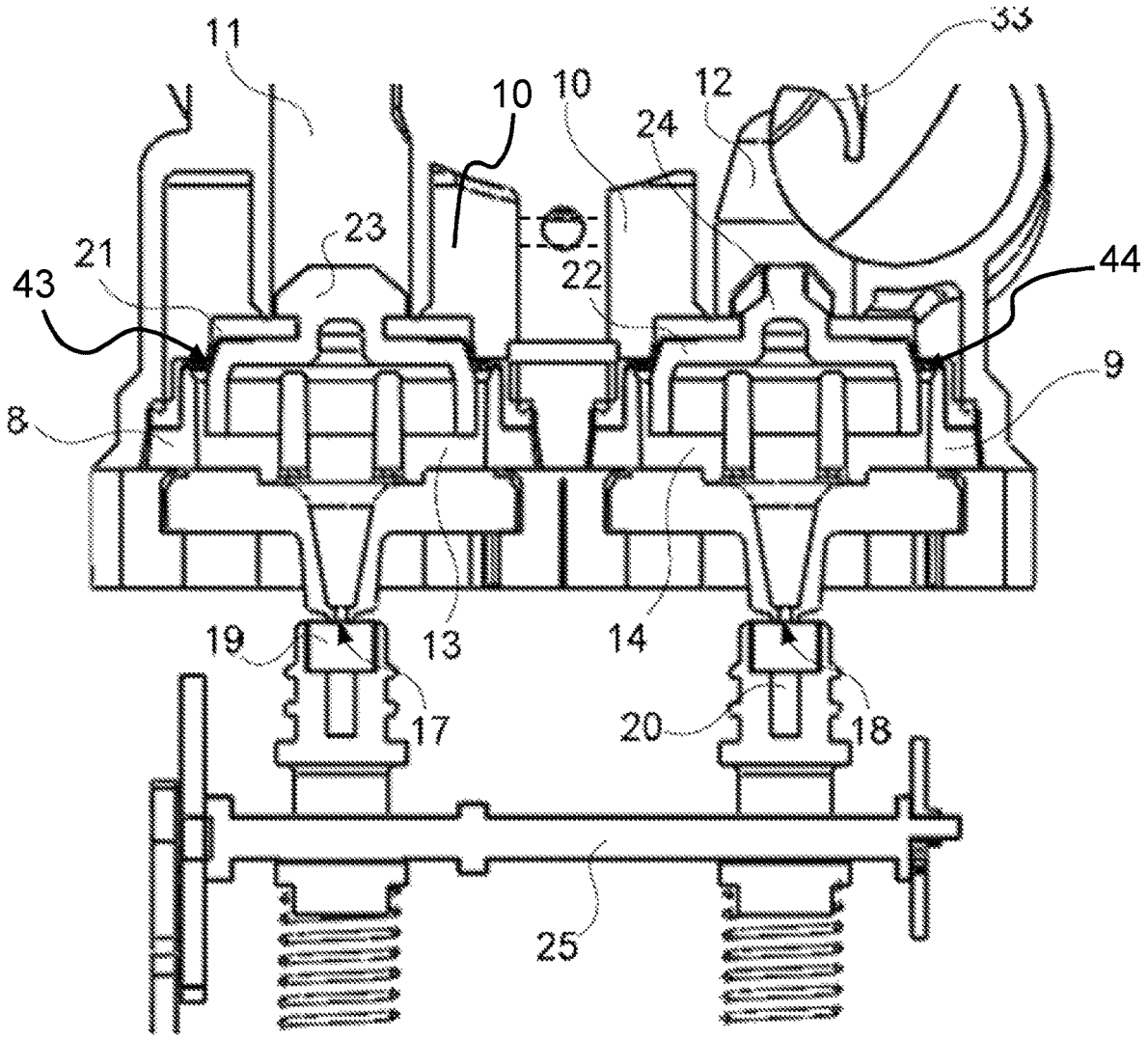
FIG. 4 shows a top view from above of the flush and filling valves according to FIG. 2 in an intermediate position, according to some embodiments.

If a flushing process is now demanded by virtue of a pressure on the triggering mechanism 1, a control unit will rotate the camshaft 25 until the cams thereof have removed the first plunger 19 from the first control opening 17, as shown in FIG. 3. As a result, the pressure in the first compensation chamber 13 can decrease and become lower than in the inlet chamber 10. As a result, a first servo-diaphragm 21 is pressed away from the edge of the first outlet line 11 by means of the water pressure and the water can flow into this first outlet line 11. Nothing about the filling valve 9 changes in the meantime. This first adjustment position is retained for a flushing time specified by a microprocessor.

By way of a further rotation of the camshaft 25 into an intermediate position, the initial position is reached again (shown in FIG. 4), in which both plungers 19 and 20 close both control openings 17 and 18 again. Since a pressure can now be built up in the first compensation chamber 13 again, the pressure there increases via a first connection opening 43 in the first servo-diaphragm 21 until the pressure corresponds to the pressure in the inlet chamber 10 again. Due to the same pressure in the inlet chamber 10 and the first compensation chamber 13, the first servo-diaphragm 21 lies in front of the opening of the first outlet line 11 again and closes it. This effect results by way of the fact that the same pressure prevails in the two adjacent chambers 10 and 13, due to the connection opening 43, but the inner side of the first servo-diaphragm 21 offers a larger surface area exposed to the pressure than the surface area exposed to the pressure of the inlet chamber 10. Since this surface area is smaller, because it does not include the cross-sectional area of the outlet line, a greater pressure from within the first compensation chamber 13 acts on the first servo-diaphragm 21, and therefore the servo-diaphragm deflects in the direction of the first outlet line 11.

Figure 5:
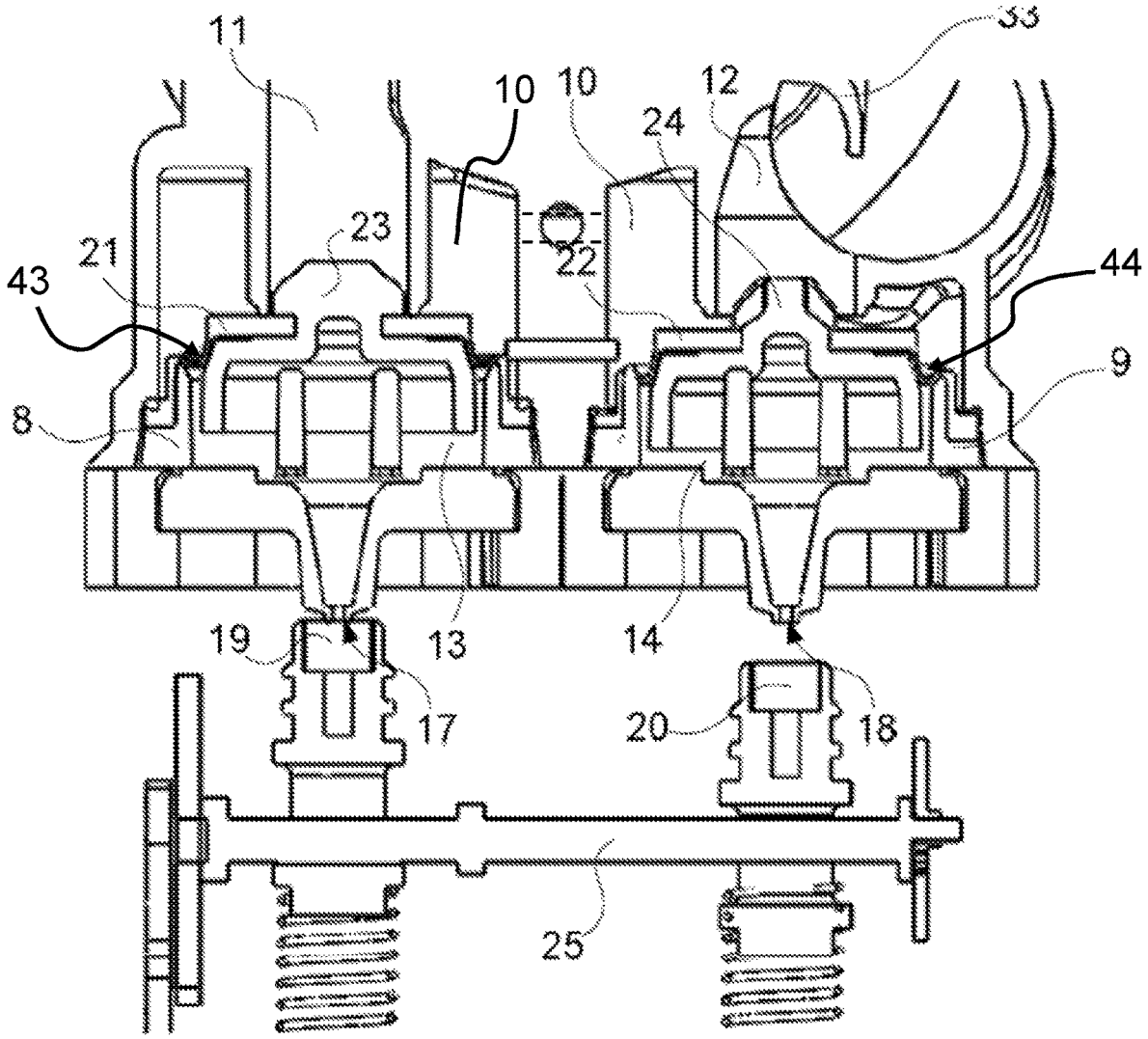
FIG. 5 shows a top view from above of the flush and filling valves according to FIG. 2 in a second adjustment position, according to some embodiments.

The arrangement remains in this position for approximately one second until the first servo-diaphragm 21 rests securely on the first outlet line 11 again. The camshaft 25 then rotates further and lifts the second plunger 20 off of the second control opening 18, as shown in FIG. 5. In this case as well, the pressure in the second compensation chamber 14 now decreases and the servo-diaphragm 22 is pushed aside, and therefore the water can enter the second outlet line 12 and, from there, can enter a filling line. As soon as the fill level has reached the maximum value again, the means for fill-level measurement transmits yet another signal to the control unit and the camshaft 25 is moved back into the start position. Since a pressure can now be built up in the second compensation chamber 14 again, the pressure there increases via a second connection opening 44 in the second servo-diaphragm 22 until the pressure corresponds to the pressure in the inlet chamber 10 again. Due to the same pressure in the inlet chamber 10 and the second compensation chamber 14, the second servo-diaphragm 22 lies in front of the opening of the second outlet line 12 again and closes it.

Figure 6:
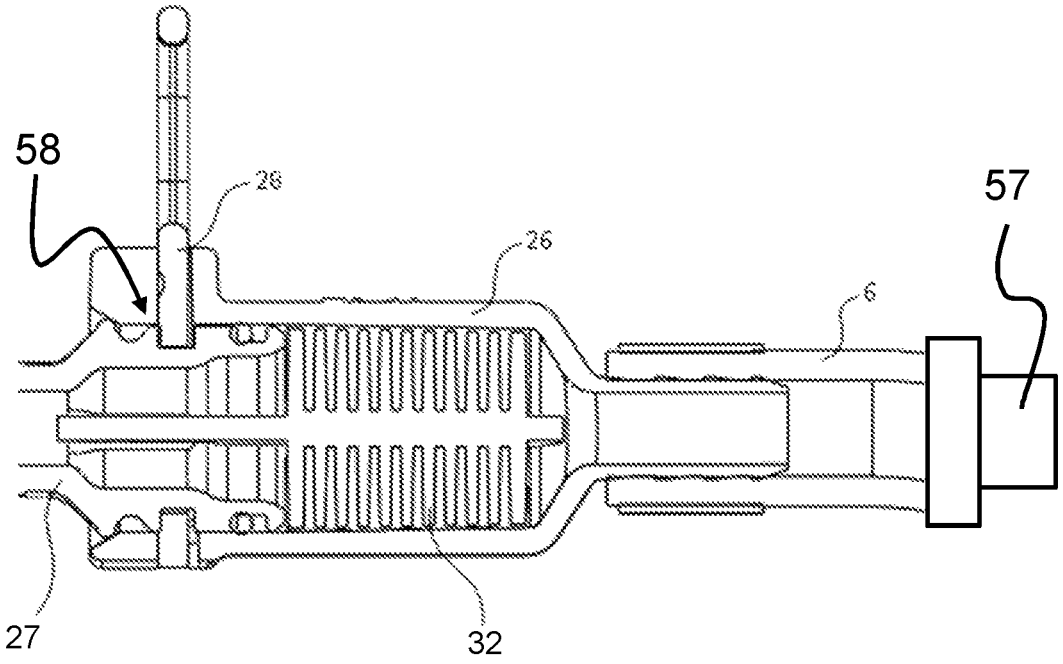
FIG. 6 shows a cross-sectional view from the side of coupling including a filter insert, according to some embodiments.
Figure 7:
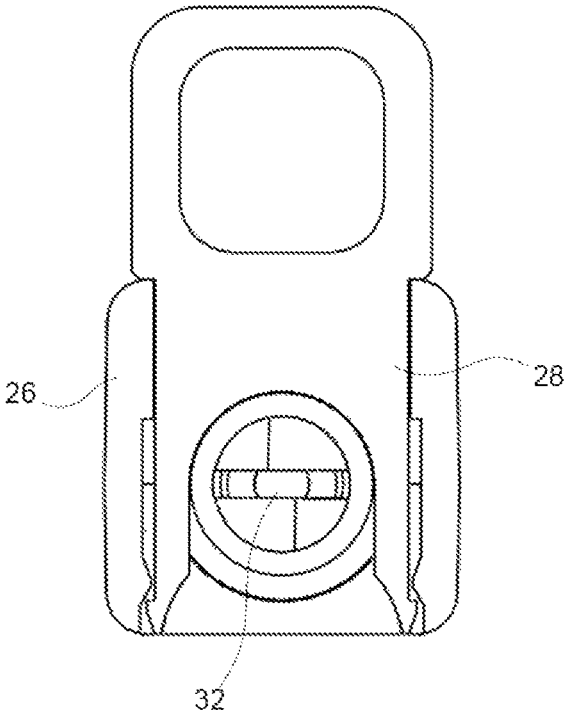
FIG. 7 shows a cross-sectional top view of the coupling according to FIG. 6, according to some embodiments.

FIG. 6 shows yet another aspect of the disclosure. In order to avoid damage to the structure and to keep pollution loads out of the cistern, a coupling 26, into which a filter insert 32 has been inserted, is situated at the end of the inlet tube 6 connected to the supply line 57. Due to this position, this filter insert 32 can be very easily accessed and cleaned. By removing a yoke 28 from the coupling 26, the connection to an inlet line 27, which is held merely by means of a force fit, can be opened. Since the supply line 57 is generally under line pressure, however, the water line must, in some embodiments, be initially turned off, so that the yoke 28 can be removed and the line can be disconnected. FIG. 7 shows a top view of the yoke 28. If the yoke 28 is removed upward in the image, the coupling 26 releases the filter insert 32 which can therefore be removed and cleaned. The inlet tube 6 is connected to the inlet line 27 via a clamp connection 58.

Figure 8:
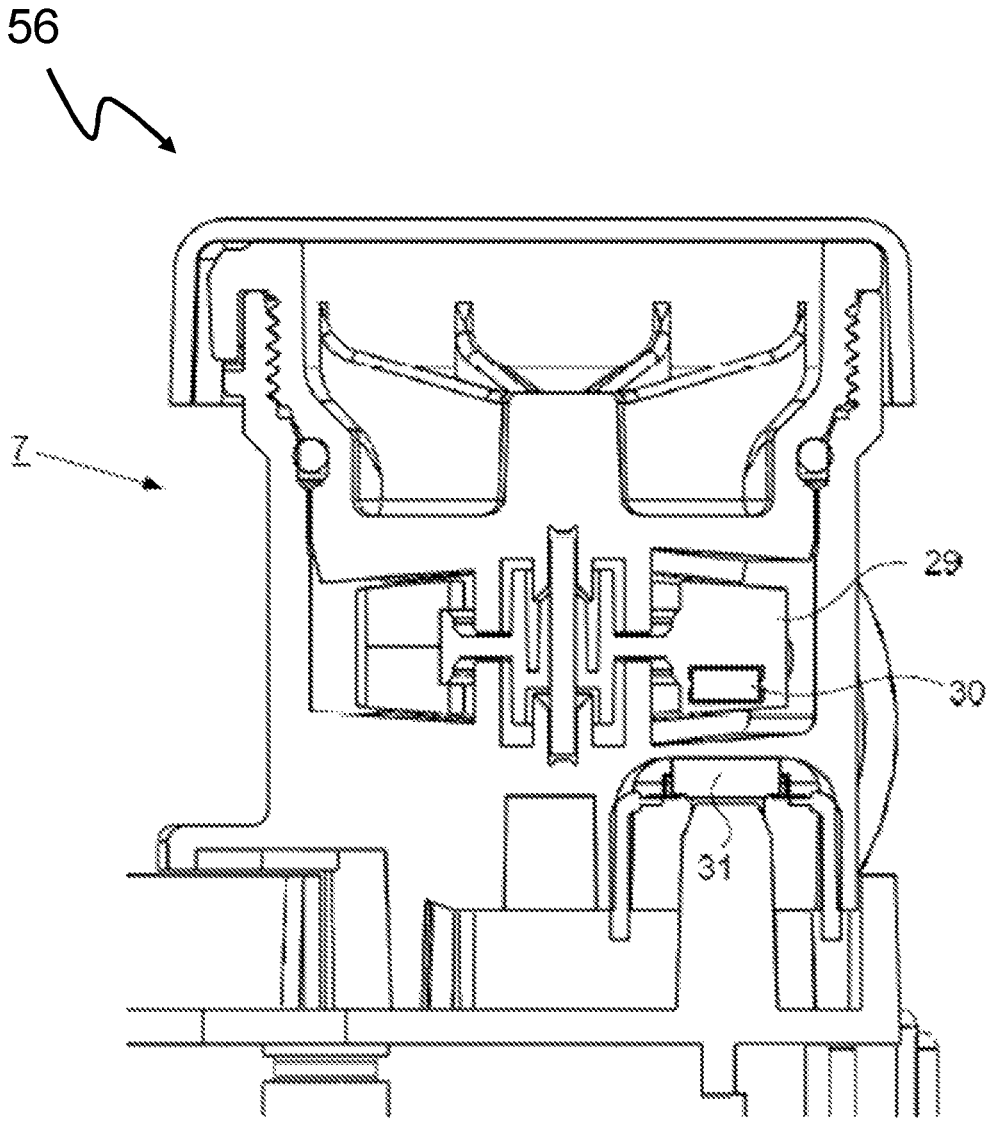
FIG. 8 shows a cross-sectional view from the side of a flowmeter, according to some embodiments.

FIG. 8 also shows a volumetric flow rate detection device 56 comprising a flowmeter 7 which substantially consists of an impeller 29 which has been inserted into the inlet line or inlet tube 6. The impeller 29 comprises, on one blade thereof, a permanent magnet 30 which passes over a reed contact 31. Each passage over the reed contact is assumed to be one revolution of the impeller 29. During production, it is established which quantity of water corresponds to one revolution-. In the example, approximately 10 ml were measured per revolution.

Figure 9:
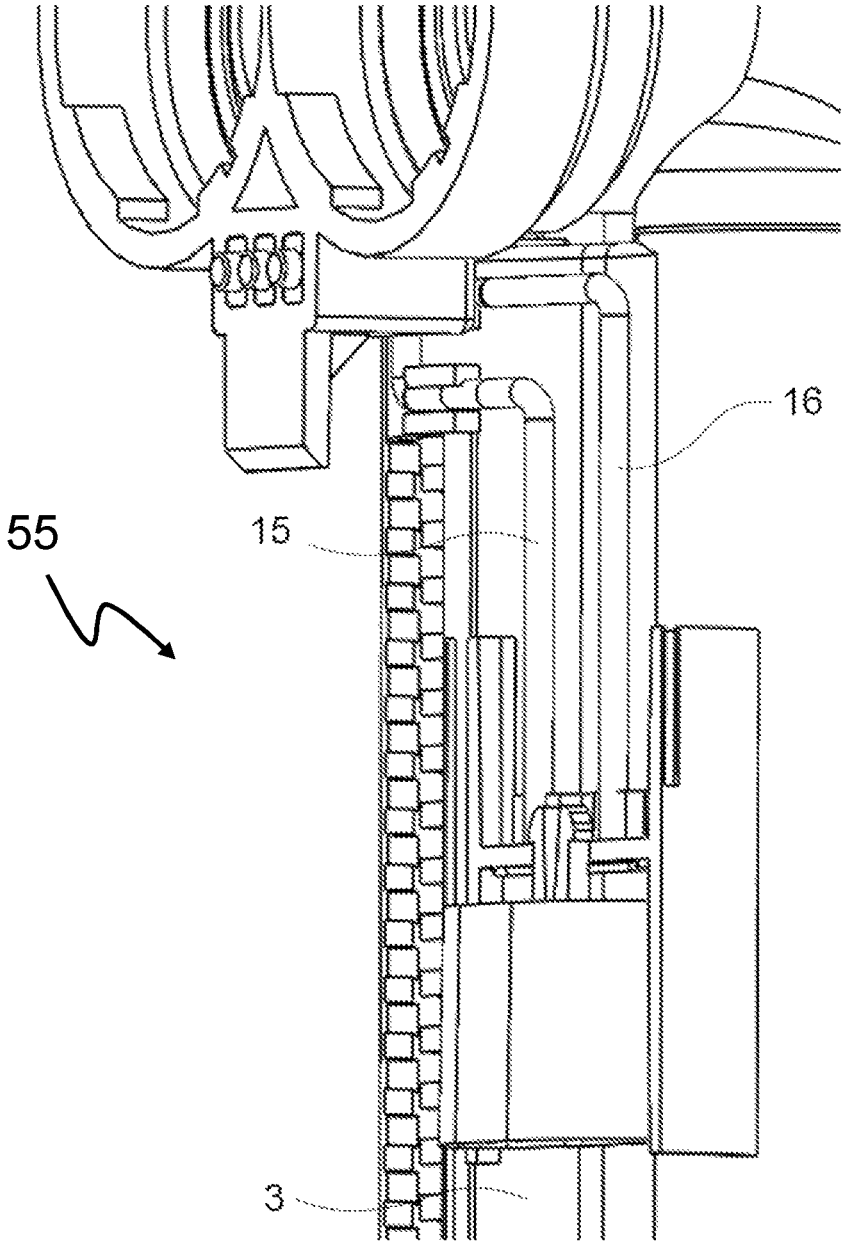
FIG. 9 shows a perspective representation obliquely from the front of a detail of the cage including two doped silicone electrodes for fill-level measurement, according to some embodiments.

FIG. 9 shows a combined flushing and filling unit with a fill-level detection device 55, wherein on the outer wall of the cage 3 two silicone electrodes 15 and 16 are situated. These are electrically connected to the control unit. If the water level in the cistern rises during the filling process, water will be present around the two silicone electrodes 15 and 16 at some point. Even though the silicone electrodes 15 and 16 are made of silicone and, therefore, are water-resistant, they are wholly conductive, due to their conductive, metal doping, and therefore an infinite resistance is initially measured in the case of a resistance measurement of the interspaced silicone electrodes 15, 16. If water is now present around the two silicone electrodes 15, 16, the resistance between the two decreases, and this can be detected with the aid of the control unit. The signal produced in this case indicates a complete filling of the cistern and brings about the conclusion of the filling process.

Described above, therefore, is a combined flushing and filling unit for use in a cistern, in which the filling valve and the flush valve are combined in one component and are situated in a shared inlet chamber. Each of the valves can be actuated by way of an induced pressure decrease in a compensation chamber using a very small amount of mechanical outlay, while the line pressure is responsible for the substantial portion of the actuation.

Figure 10:
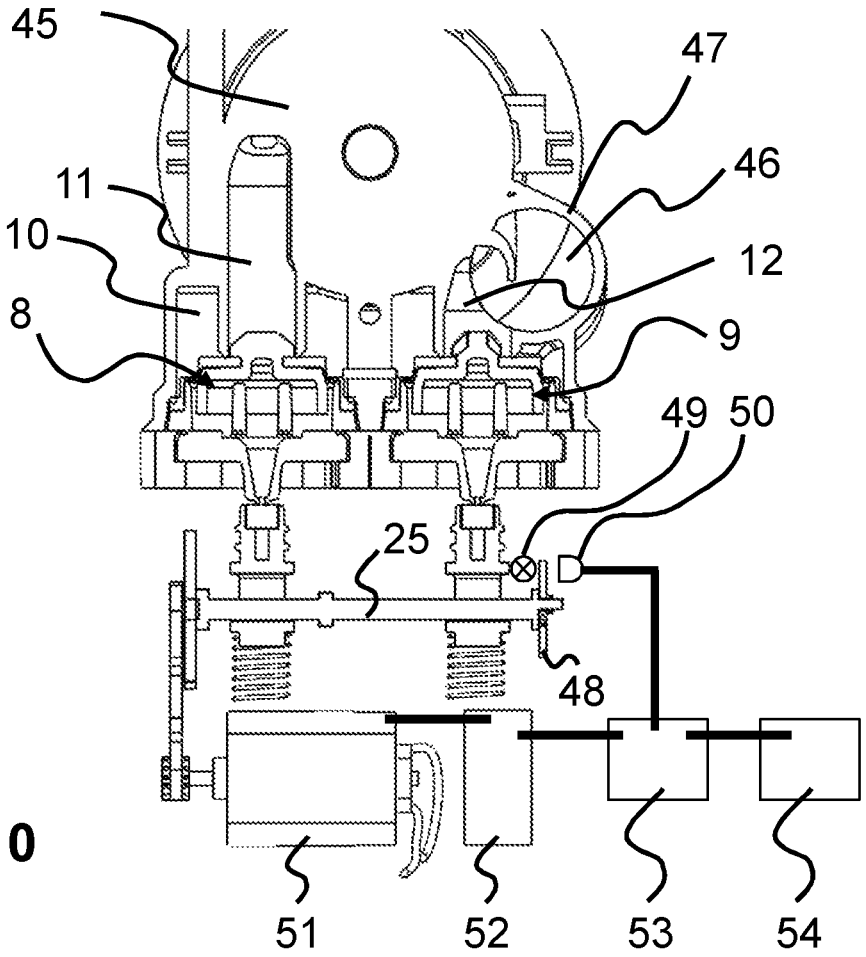
FIG. 10 shows a further detail of the flushing and filling unit, according to some embodiments.

FIG. 10 shows that the second outlet line 12 of the filling valve 9 opens into a filling line 46 of the cistern and the first outlet line 11 of the flush valve 8 leads into an inlet line of a cylinder of a cylinder-piston unit 45 for triggering the flushing process. The filling line 46 is a vertical downpipe which comprises an air tube 47, which is open at one end, above an opening into the filling line 46.

It is further shown that the camshaft 25 is driven by an electric motor 51. The electric motor 51 is controlled by a control unit 52 which receives input signals from various signal transmitters and sensors, evaluates the input signals, and then outputs adjustment signals to the electric motor 51, in order to move the electric motor 51 and, therewith, the camshaft 25.

The control unit 52 is connected in a data-sharing manner to a timer of a microprocessor 53, which is electrically connected to a potentiometer 54 for adjusting a setpoint flushing quantity defined via a time period. The control unit 52 is connected in a data-sharing manner to a fill-level detection device 55.

The camshaft 25 comprises a light wheel 48 consisting of a wheel which is connected to the camshaft and includes inscribed recesses or passages. By means of a lamp 49 and a photoreceptor 50 oriented toward the lamp 49, including the light wheel 48 situated therebetween, the present rotational position of the light wheel 48 can be deduced on the basis of gap widths and resultant light intensities. The control unit 52 receives sensor signals from the aforementioned photoceptor 50 regarding the position of the camshaft 25.

Figure 11:
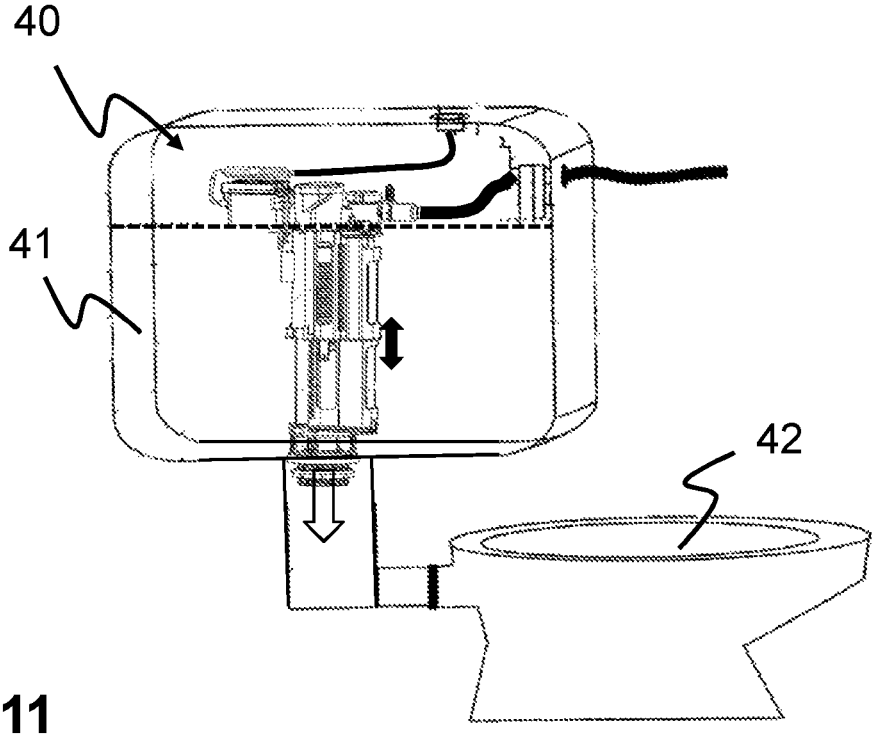
FIG. 11 shows a flushing and filling unit installed in a cistern of a toilet, according to some embodiments.

FIG. 11 shows a compact combined flushing and filling unit 40 installed, in entirety, in a cistern 41 of a toilet 42.

The present disclosure relates to a combined flushing and filling unit for use in a cistern. Many solutions in this regard are known in the prior art, which comprise a filling valve and a separate flush valve and decouple these two processes. Multiple structural units are often also utilized for this purpose, wherein each structural unit is utilized for one of the two functions. The problem addressed by the present disclosure is that of providing an efficient, cost-effectively manufacturable and economical, as well as efficiently functioning solution which is de-signed as one piece and is universally usable. This problem is solved in that the filling valve and the flush valve are combined in one component and are situated in a shared inlet chamber. Each of the valves can be actuated by way of an induced pressure decrease in a compensation chamber using a very small amount of mechanical outlay, while the line pressure is responsible for the substantial portion of the actuation.

The invention claimed is:

1. A combined flushing and filling unit comprising:

a flush valve and a filling valve, which are situated in an inlet chamber to which line pressure is to be applied; and a compensation chamber between the inlet chamber and a first outlet line and a second outlet line, the compensation chamber being closed with the aid of a servo-diaphragm, wherein the inlet chamber communicates with the compensation chamber via a connection opening in each case, in the servo-diaphragm, and the compensation chamber has a control opening for generating a pressure decrease, which releases the first outlet line or the second outlet line in the compensation chamber.

2. The combined flushing and filling unit of claim 1, wherein the second outlet line opens into a filling line of a cistern and the first outlet line leads into an inlet line for triggering a flushing process.

3. The combined flushing and filling unit of claim 2, wherein the inlet line is an inlet line of a cylinder-piston unit.

4. The combined flushing and filling unit of claim 1, wherein the control opening is closable with the aid of a plunger which is actuatable via a rotatably mounted camshaft.

5. The combined flushing and filling unit of claim 4, wherein the plunger is resiliently mounted and, due to its resilience, returns to a closed position.

6. The combined flushing and filling unit of claim 4, wherein a light wheel is assigned to the camshaft, and a position detection of the light wheel is implemented with the aid of a lamp and a photoreceptor.

7. The combined flushing and filling unit of claim 4, wherein the camshaft is driven via an electric motor which is controlled by a control unit.

8. The combined flushing and filling unit of claim 7, wherein the control unit is connected in a data-sharing manner to a timer of a microprocessor or to a quartz.

9. The combined flushing and filling unit of claim 8, wherein the timer of the microprocessor is electrically connected to a potentiometer for adjusting a setpoint flushing quantity defined via a time period.

10. The combined flushing and filling unit of claim 7, wherein the control unit is connected in a data-sharing manner to a fill-level detection device.

11. The combined flushing and filling unit of claim 10, wherein the fill-level detection device comprises a pair of electrodes comprising a conductively doped silicone thread.

12. The combined flushing and filling unit of claim 7, wherein the control unit is connected in a data-sharing manner to a volumetric flow rate detection device.

13. The combined flushing and filling unit of claim 12, wherein the volumetric flow rate detection device comprises a flowmeter which is formed by an impeller situated in a line flow of a supply line, which influences a reed contact stationarily situated in a region of the impeller with the aid of a permanent magnet mounted on the impeller.

14. The combined flushing and filling unit of claim 1, wherein the compensation chamber is a plurality of compensation chambers between the inlet chamber and the first and second outlet lines, each of the compensation chambers being closed with the aid of each of a plurality of servo-diaphragms, and the inlet chamber communicates with the compensation chambers via the connection opening in the servo-diaphragm.

15. The combined flushing and filling unit of claim 14, wherein the second outlet line opens into a filling line of a cistern and the first outlet line leads into an inlet line for triggering a flushing process.

16. The combined flushing and filling unit of claim 15, wherein the inlet line is an inlet line of a cylinder-piston unit.

17. The combined flushing and filling unit of claim 14, wherein the flush valve and filling valve are situated adjacent to each other.

18. The combined flushing and filling unit of claim 1, wherein the flush valve and filling valve are situated adjacent to each other.

19. A method for the operation of a combined flushing and filling unit comprising a flush valve for triggering an emptying process of a cistern, and a filling valve for triggering a filling process, wherein the flush valve and the filling valve are situated adjacent to each other and the actuation of said valves take place via a control unit by way of an electric motor-controlled camshaft, the method comprising:

rotating the camshaft out of a start position into a first adjustment position, in which only the flush valve is actuated;

after a flushing time specified by a microprocessor, rotating the camshaft further into a second adjustment position, in which only the filling valve is actuated;

holding the camshaft in position until a fill-level detection device signals a complete filling of the cistern back to the control unit; and rotating the camshaft back into the start position.

20. The method of claim 19, wherein, between the first adjustment position and the second adjustment position, an intermediate position is approached, in which the flush valve and the filling valve are closed and remain there for a closing duration of the flush valve.

* * * * *